US006023250A

United States Patent [19]

Cronyn

[11] Patent Number: 6,023,250

[45] Date of Patent: Feb. 8, 2000

[54] COMPACT, PHASABLE, MULTIOCTAVE, PLANAR, HIGH EFFICIENCY, SPIRAL MODE ANTENNA

[75] Inventor: Willard M. Cronyn, San Diego, Calif.

[73] Assignee: The United States of America as represented by the Secretary of the Navy, Washington, D.C.

[21] Appl. No.: 09/107,901

[22] Filed: Jun. 18, 1998

[51] Int. Cl.[7] ..... H01Q 1/36

[52] U.S. Cl. ..... 343/895

[58] Field of Search ..... 343/778, 792.5, 343/867, 895, 868; H01Q 1/36, 1/38, 11/08

[56] References Cited

U.S. PATENT DOCUMENTS

| | | | |
|---|---|---|---|
| 2,990,548 | 6/1961 | Wheeler . | |
| 3,454,951 | 7/1969 | Patterson et al. . | |
| 3,465,346 | 9/1969 | Patterson et al. . | |
| 3,555,554 | 1/1971 | Kuo . | |
| 3,562,756 | 2/1971 | Kuo et al. . | |
| 3,624,658 | 11/1971 | Voronoff . | |
| 3,828,351 | 8/1974 | Voronoff . | |
| 3,906,514 | 9/1975 | Phelan . | |
| 3,949,407 | 4/1976 | Jagdmann et al. . | |
| 4,243,993 | 1/1981 | Lamberty et al. . | |
| 4,605,934 | 8/1986 | Andrews | 343/895 |
| 4,608,572 | 8/1986 | Blakney et al. | 343/792.5 |
| 4,630,064 | 12/1986 | Andrews et al. . | |
| 4,636,802 | 1/1987 | Middleton | 343/895 |
| 5,053,786 | 10/1991 | Silverman et al. . | |
| 5,220,340 | 6/1993 | Shafai . | |
| 5,227,807 | 7/1993 | Bohlman et al. | 343/895 |
| 5,313,216 | 5/1994 | Wang et al. . | |
| 5,451,973 | 9/1995 | Walter et al. . | |
| 5,517,206 | 5/1996 | Boone et al. . | |
| 5,589,842 | 12/1996 | Wang et al. | 343/787 |

*Primary Examiner*—Don Wong
*Assistant Examiner*—Tho Phan
*Attorney, Agent, or Firm*—Harvey Fendelman; Michael A. Kagan; Peter A. Lipovsky

[57] ABSTRACT

An antenna integrates a planar structure, wideband compact design, permitting phasability, into a single structure. The antenna design makes it possible to implement the antenna throughout the entire electromagnetic spectrum with little or no need for impedance matching. The antenna comprises a plurality of exponential-spiral shaped antenna arms in which each of the arms has a radially inner and radially outer end and in which the radially inner ends are spaced rotationally about a common axis, and in which the arms are separated circumferentially from each other in proportion to their distance from the common axis. Each of the spiral antenna arms includes an antenna element having a sinuous portion that has amplitude and period characteristics that vary in proportion to their distance from said common axis. The antenna elements are selectively coupled to an antenna feed.

11 Claims, 4 Drawing Sheets

COMPACT, PHASABLE, MULTIOCTAVE, PLANAR, HIGH EFFICIENCY, SPIRAL MODE ANTENNA

BACKGROUND OF THE INVENTION

This invention relates generally to antennas and in particular to a compact, phasable, multioctave, high efficiency, spiral mode antenna.

There have always been numerous civilian, scientific and military requirements for a generic wideband high efficiency and low profile antenna element which can be mounted close to a ground plane. Some, but not all, of these requirements have been met with the designs of previous antennas. The history of these antenna elements can be traced back to the conical log spiral antenna. This antenna consists of two conducting sheets on a dielectric cone; the conducting sheets are fed at the cone apex with the energy traveling down the cone towards its base. The active (radiating) region of the cone is the point at which the phase of the wave traveling down the cone changes by approximately 360 degrees around the circumference of the cone. In this region a circularly polarized, backward-traveling wave is launched (passing the cone apex), having a polarization opposite to that of the element winding direction, i.e. if a right-hand wave travels down the cone, the radiated wave is left circularly polarized. If the element is a self-conjugate antenna, the conducting and non-conducting areas are equal and the two areas will be precisely interchanged under a physical 90 degree rotation.

Erickson and Fisher (Reference 1) improved upon the log spiral in a design for an element utilized in a decametric-wavelength (15–110 MHZ or 2.7–20 meters) phased-array radio telescope by replacing the balanced conducting sheets (which would present construction and wind-loading difficulties for an element designed to operate at meter wavelengths with 3 wires, i.e., the edges were defined by wires (2 wires, 1 for each edge), with a third wire located along the centerline of each surface. They also realized that the element could be operated below its cut-off frequency (the frequency at which the circumference at the base of the element was approximately 1 wavelength), albeit at reduced efficiency, by resistively terminating the element windings, at the base of the element, in the characteristic impedance of the element. The two wire-defined "surfaces" were fed through a balun (balanced-to-unbalanced transformer) from coaxial cable. Another opposed pair of winding wires between the two surfaces was electrically disconnected. Arrays of 15 elements each could be phased to a desired direction simply by electronically switching the balun to the appropriate 6 out of 8 element windings, thereby changing the phase of each element in 45-degree increments. Important conclusions they drew from precise and exhaustive measurements were: (1) the half-power beamwidth was about 100 degrees, centered on the zenith; (2) the element efficiency was within 1 to 3 dB of that of a reference dipole antenna; (3) the element phasing did indeed change by 45 degrees per rotation step; (4) cross-polarization varied from less than 5% at frequencies below 50 MHZ to 20% at 110 MHZ; and (5) the element retained its high efficiency even down to frequencies for which the radiating region was close to the ground. Conclusion (5) is implicit in their results but is not explicitly stated in their analysis. However, it is extremely important in considering how well an active region will radiate, and maintain its impedance, when it is located very close to a ground plane. The height of their log spiral antenna was 7.2 meters.

A broadband but linearly-polarized antenna (Reference 2) constructed with wire elements outlining current sheet surfaces also displayed efficient operation at frequencies for which the active radiating region was very close to a ground plane. However, it had no phasing capability.

An advance in log spiral antennas was made by Wang and Tripp (References 3–5) who designed a planar log spiral antenna which could be operated at a very small fraction of a wavelength above a ground plane, thereby resulting in a low-profile element suitable for a variety of civilian and military applications. In commercial literature describing the antenna element, they refer to a compact version of the element which, however, has only limited bandwidth.

SUMMARY OF THE INVENTION

The invention integrates a planar structure, wideband compact design, that permits phasability, into a single antenna structure. The antenna design makes it possible to implement the antenna throughout the entire electromagnetic spectrum with little or no need for impedance matching. The antenna comprises a plurality of exponential-spiral shaped antenna arms in which each of the arms has a radially inner and radially outer end and in which the radially inner ends are spaced rotationally about a common axis, and in which the arms are separated circumferentially from each other in proportion to their distance from the common axis. Each of the spiral antenna arms includes an antenna element having a sinuous portion that has amplitude and period characteristics that vary in proportion to their distance from said common axis. An antenna feed is selectively coupled to the antenna elements.

OBJECTS OF THE INVENTION

It is an object of the invention to provide an improved antenna.

Another object of the invention is to provide an antenna whose design is frequency independent.

Another object of the invention is to provide an antenna that is dimensionally compact.

Yet another object of the invention is to provide an antenna that is wide-band.

Another object of the invention is to provide an antenna that permits ease of phase changing.

Yet another object of the invention is to provide an antenna structure that permits ease of feed mode changing.

Still yet another object of the invention is to provide an antenna that requires a minimum of impedance tuning.

Other objects, advantages and new features of the invention will become apparent from the following detailed description of the invention when considered in conjunction with the accompanied drawings.

DESCRIPTION OF THE PREFERRED EMBODIMENT

Figure 1:
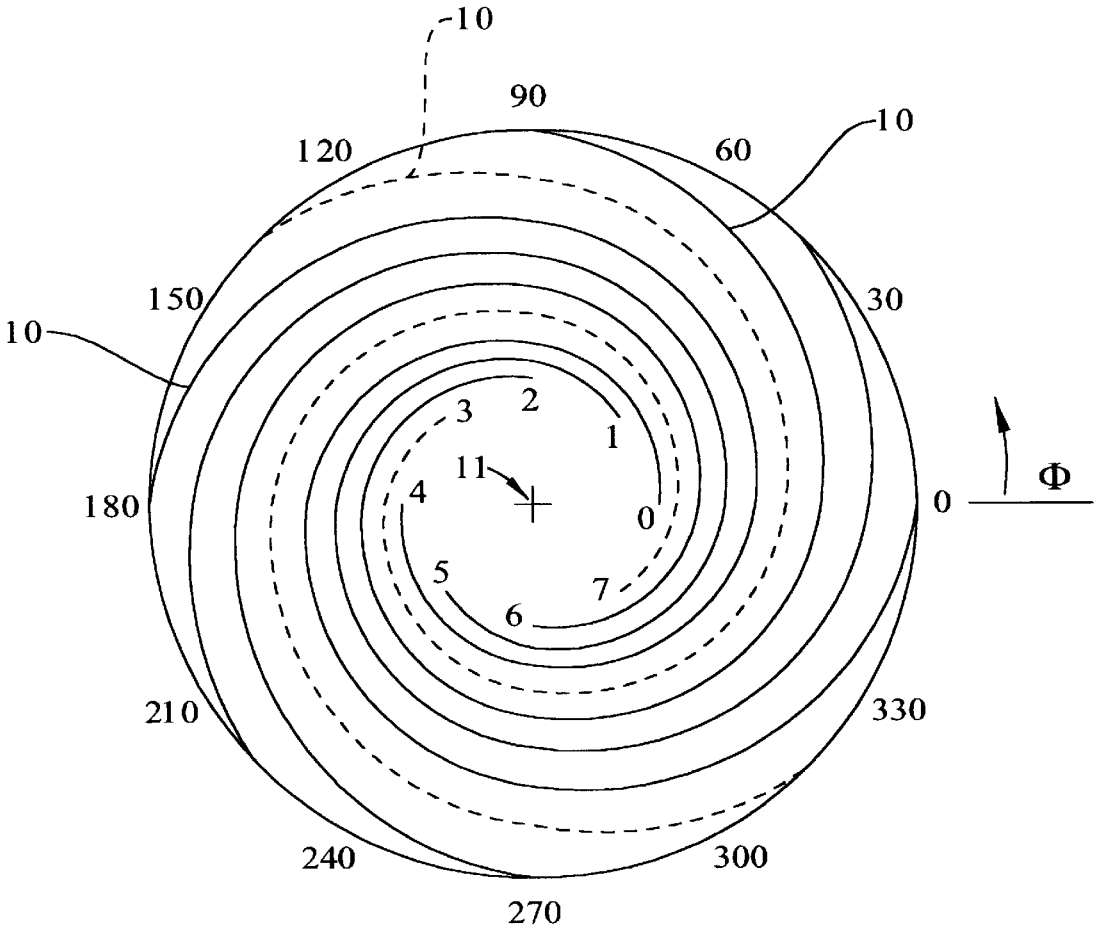
FIG. 1 illustrates spiral shaped antenna arms according to one embodiment of the invention.

Referring to FIG. 1, an antenna according to a preferred embodiment of the invention begins with the paths of eight spiral shaped antenna arms 10, each one of which follows an exponential spiral described by equation (1) as follows:

$$r(\Phi)=r1\cdot\exp(\beta\cdot\Phi), \qquad \text{eq. (1)}$$

where $\Phi$ is the polar angle in units of rotation, r is the radius from the origin or spiral axis 11, r1 is a chosen constant and $\beta$ is a radial scale factor, i.e., each arm rotation increases its radius by exp ($\beta$). FIG. 1 illustrates the path of the eight spiral arms in which the radially inner ends of the arms (indicated by reference numbers 0–7) are spaced rotationally about common origin/axis 11, each arm 45 degrees from a previous arm. According to this embodiment, arms 10 separate circumferentially from each other in proportion to their distance from origin/axis 11, so that the further the arms from origin/axis 11, the greater the arms separate from each other.

Figure 2A:
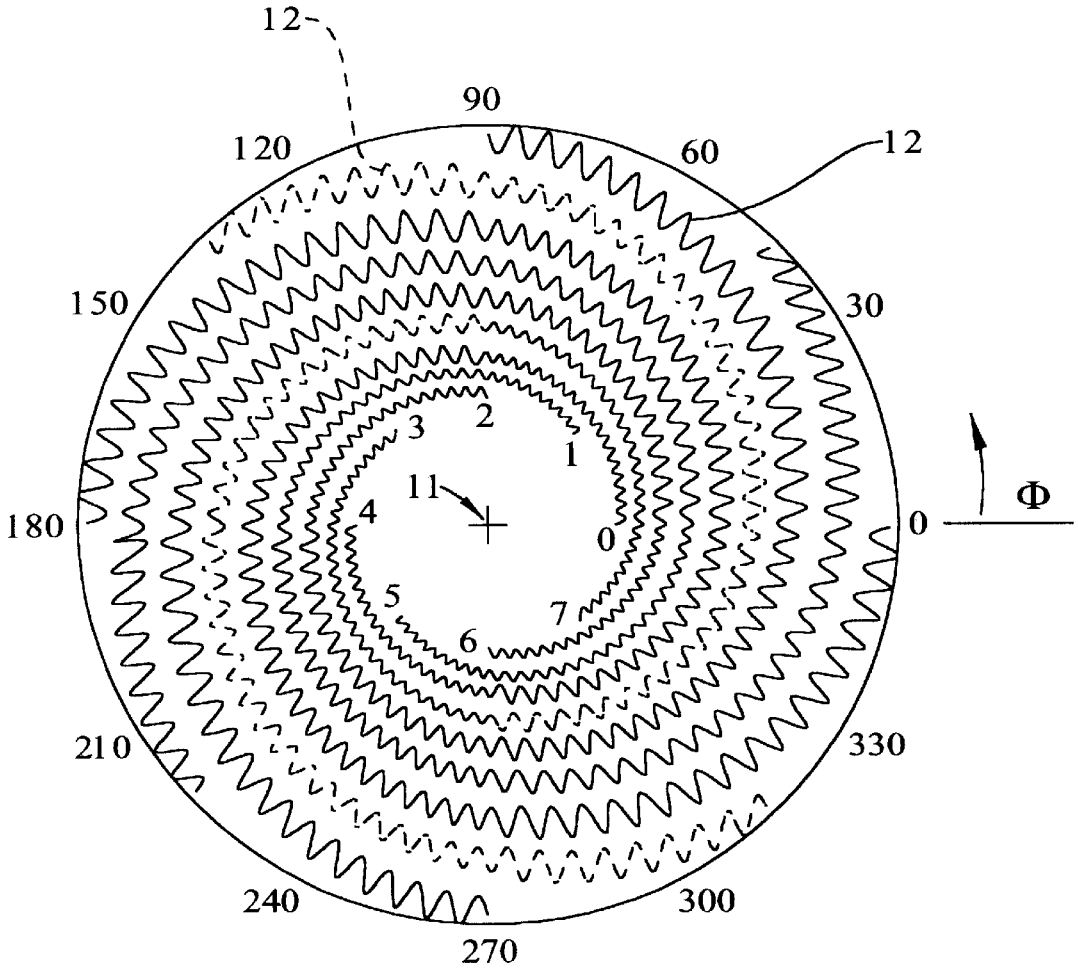
FIG. 2A illustrates sinuous antenna elements following the path of spiral shaped antenna arms according to one embodiment of the invention.
Figure 2B:
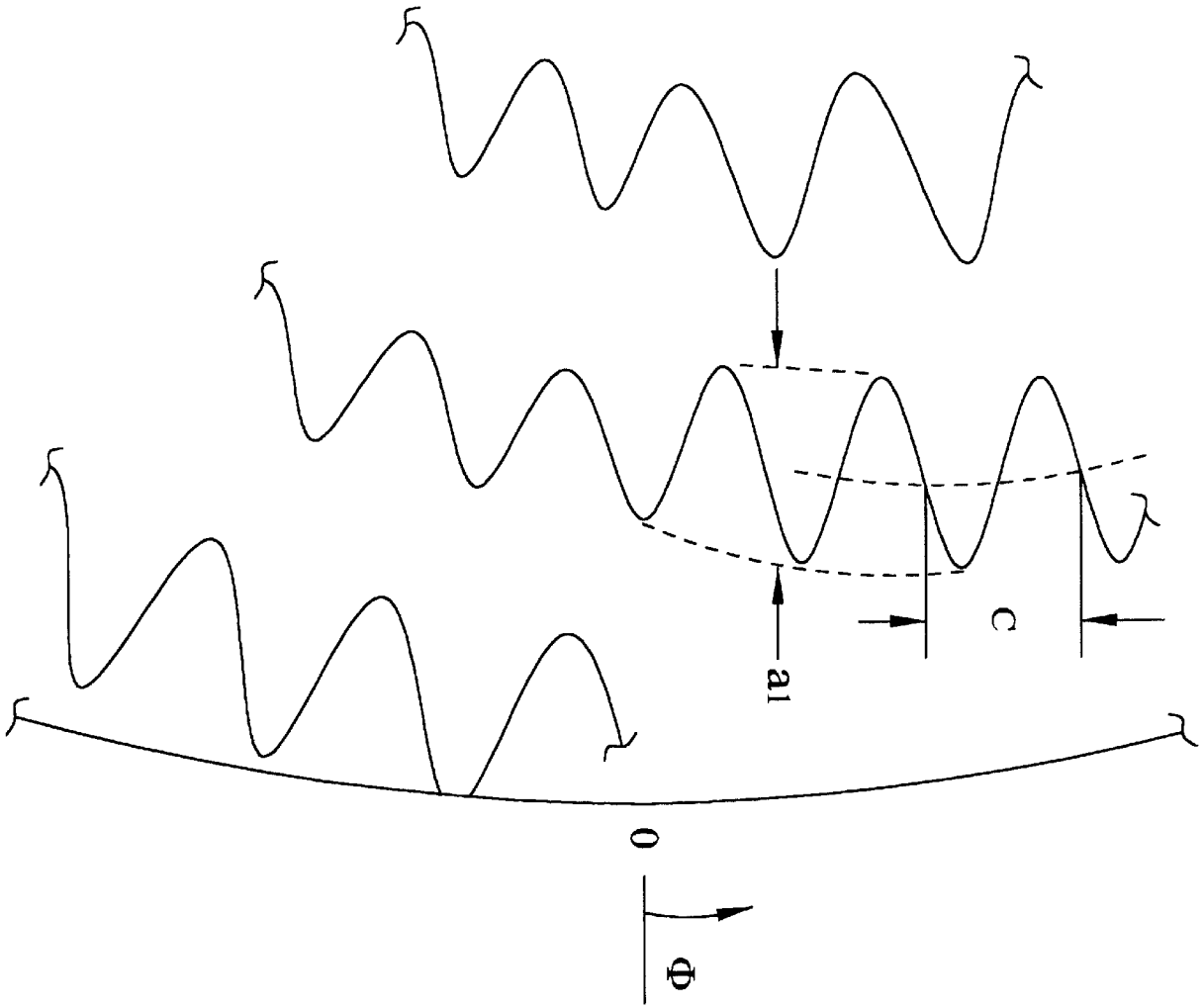
FIG. 2B is an enlarged view of a portion of FIG. 2A illustrating features of the sinuous antenna elements to one embodiment of the invention.

According to the invention, the spiral arms are refined according to the imposition of a sinuous variation on the spiral windings. Referring to FIG. 2A, conductive antenna elements 12 are designed to follow the path of sinuously varied spiral arms 10, shown in FIG. 1, and can be fabricated of planar wires such as printed circuit board traces on a dielectric substrate for microwave frequencies or can be heavy gage wire at lower frequencies. The sinuous variation increases the path length for each element winding rotation so that the circumference through which the phase increases by 360 degrees is correspondingly decreased. The path deviation of the sinuous variation from that of the spiral may be written as:

$$y(\Phi)=a1\cdot r(\Phi)\cdot\sin(2\cdot pi\cdot N\cdot\Phi), \qquad \text{eq. (2)}$$

where a1 is the amplitude of the sinuous variation as a function of radius and N is the number of sinuous cycles per rotation of $\Phi$, these characteristics being illustrated further in FIG. 2B.

Thus the sinuous deviation is proportional to the spiral arm radius. As the active region of the antenna element will always be at a radius which is proportional to wavelength, the sinuous amplitude itself is proportional to wavelength. Further, the spatial period of the sinuous term is a constant fraction (1/N) of the circumference, so all parameters scale in proportion to wavelength—the active region physical parameters, normalized by wavelength, are a constant, which is an important consideration for a wideband antenna. Further, as the design parameters of the invention are proportional to the antenna's operating wavelength, the impedance of the antenna will remain close to constant, minimiing the need for impedance tuning. When N is an integer multiple of 8, it is known that the sinuously varied elements will not physically interfere.

The ratio of the path length along the sinuous element windings to an undeviated winding is given by the following equation (3) integral:

$$\frac{2}{\pi}\int_0^{\frac{\pi}{2}}\sqrt{1+(N\cdot a1\cdot\cos(\zeta))^2}\,d\zeta \qquad \text{eq. (3)}$$

Where $\xi$=local angle (in radians) governing the sinuous variation so that as $\xi$ advances from 0 to $2\pi$, a complete sinuous cycle will be traced out. The inverse of the ratio given by equation (3) is the velocity factor, so-called because it is the ratio of the sinuous circumferential propagation velocity to the undeviated propagation velocity, which is approximately the speed of light.

In FIG. 2A, an example of an element with a slow-wave velocity factor of 2, or velocity factor of 0.5, is shown. The following further numerical description and calculations can be used for the specific sinuously varied spiral configuration shown in FIG. 2A:

$$sf=3;\ vel\ fac=0.5;\ rot=1;\ Nwind=8;\ Nfac=8;\ N=Nwind\cdot Nfac$$

$$r1=1;\ \beta:=1n(sf);\ frq\ rat=exp[\beta\ (rot-1)];\ frq\ rat=3;$$

$$a1(x):=\frac{1-\exp(-\beta)}{x}$$

$$\text{vel factor}(x)=\frac{1}{\frac{2}{\pi}\int_0^{\frac{\pi}{2}}\sqrt{1+(N\cdot a1(x)\cdot\cos(\zeta))^2}\,d\zeta}$$

ti dfac=16.362; a1(dfac)=0.041

$$r(\Phi)=r1\cdot exp(\beta\cdot\Phi);\ y(\Phi):=r(\Phi)\cdot(1+a1(dfac)\cdot sin(2\cdot\pi\cdot N\cdot\Phi))$$

In which:

"sf"=a scaling factor equaling the ratio of spiral arm radius after n turns to radius after n−1 turns (sf=3 equates with a spiral radius that increases by a factor of 3 after each complete spiral turn)

Figure 2C:
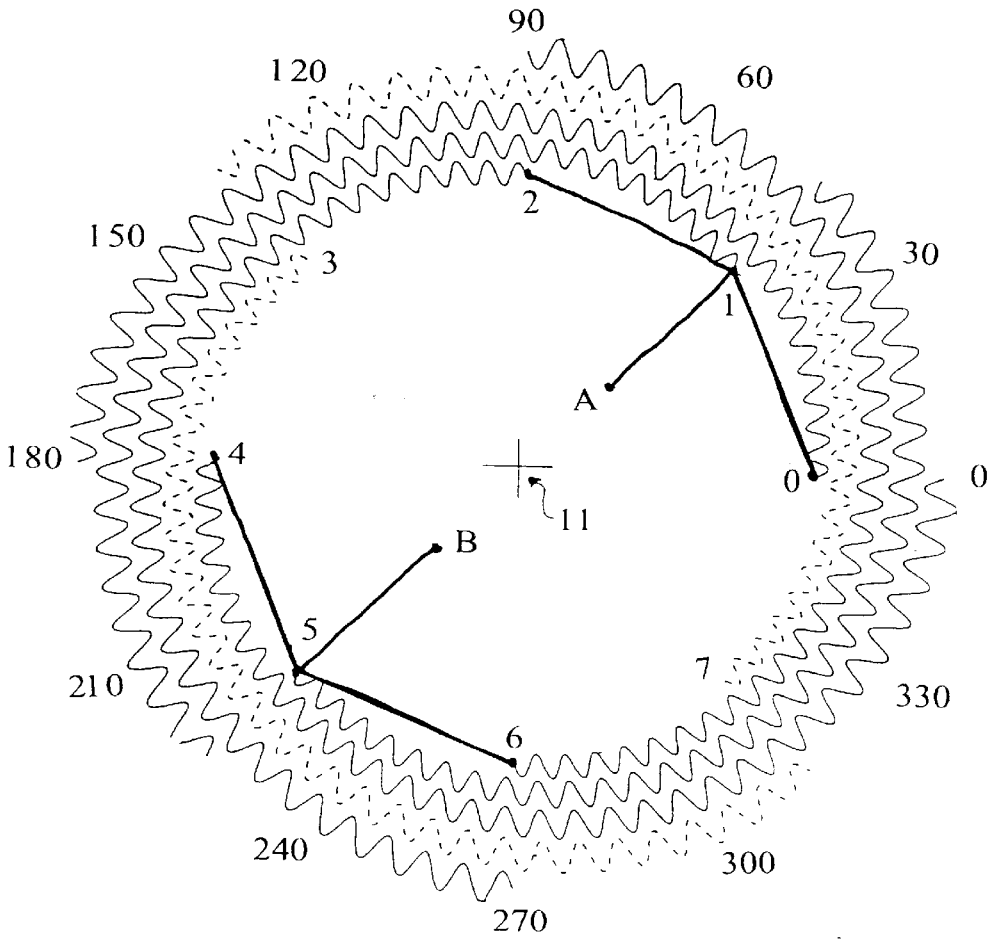
FIG. 2C is an enlarged view of a portion of FIG. 2A illustrating an exemplary feed technique according to one embodiment of the invention.

"ve1 fac"=ratio of the phase velocity through the sinuous winding to the phase velocity through the undeviated spiral winding "rot"=number of turns of each spiral arm winding "Nwind"=number of spiral arm windings "Nfac"=number of sinuous cycles, start of one spiral arm winding to the start of the next "N=Nwind·Nfac"=number of sinuous cycles per spiral arm turn r1=a constant $\beta$=the radial scale factor previously described frq rat=ratio of highest frequency to lowest=ratio of outer circumference to inner a1=amplitude of sinuous variation as a fraction of the radius as described previously $\xi$=local angle governing sinuous variation—as $\xi$ advances from 0 to $2\pi$, a complete sinuous cycle is traced out dfac=the value of "x" for a given velocity factor $\Phi$ is the spiral angle measured in units of rotation $r(\Phi)=r1\cdot\exp(\beta\cdot\Phi)$=equation of spiral trace $r(\Phi)$=distance from spiral arm origin/axis to spiral trace $y(\Phi):=r(\Phi)\cdot(1+a1(dfac)\cdot\sin(2\cdot\pi\cdot N\cdot\Phi))$=equation of sinuous trace $y(\Phi)$=distance from spiral arm origin/axis to sinuous trace FIG. 2C is an enlarged view of the innermost half turn of each of the 8 element windings of FIG. 2A. In this example of the invention, the element is fed electrically from one side, A, of a balanced transmission line by connecting 3 adjacent element windings together, e.g., element windings 0, 1, and 2 are connected, leaving the next element disconnected (floating), i.e., element winding 3 (shown dashed), then connecting to the other side, B, of the balanced transmission line the next 3 element windings together, i.e., 4, 5, and 6, and leaving the next element winding disconnected/floating, i.e., element winding 7 (shown dashed).

For the purpose of phasing two or more antennas together for directional beam control, the particular grouping of antenna element windings can be changed. For example, a linear array of antennas can be phased with a 45-degree phase gradient from one antenna to the next. Assuming that antenna element winding number 0 for each antenna is always at a reference direction, e.g., north, then the gradient would result if, for the first antenna, the element windings are connected as described above, and for the second antenna, element windings 1, 2 and 3 were connected to side A of the transmission line, while 5, 6, and 7 are connected to side B. For the third antenna, element windings 2, 3, and 4 would be connected to A and 6, 7, and 0 would be connected to B, elements 0 and 4 being left disconnected, etc.

The connections as described above give rise to a so-called Mode 1 antenna pattern characterized by a maximum response in the direction perpendicular to the plane of the antenna array. However, the access to the individual element windings of the invention also makes it easy to excite other modes.

To eliminate reflections and extend the usable low frequency response of the antenna, the element windings should be terminated with a resistive load, not shown. For a self-conjugate antenna, the theoretical feed-point impedance is 189 ohms so that for 3 element windings in parallel, the theoretical impedance of each is approximately 570 ohms. Thus the outer end of each element winding requires a termination of 570 ohms.

It should be noted that the radiation resistance of the compact spiral mode antenna will be significantly less than the theoretical 189 ohms, depending on the slow-wave velocity factor. However, this reduction in impedance could even be a design parameter by itself in the sense that an antenna engineer may wish to attain a desired element impedance by intentionally "tuning" the amplitude of the sinuous variation.

Typically the connection of the element windings to the transmission line would be done through electronic switches for control of the antenna feed. In Reference (6) there is an example of such a switching scheme implemented using diode switches. However, for high-power transmitting applications, where diode switches would not be suitable, electromechanical relays can be used.

In comparison with prior art antenna elements, this element integrates a planar structure, wideband compact design, and phasability into a single physical structure. In addition, because of access to the windings, the feed mode can be easily changed. The design is generic and frequency-independent in the sense that the same design equations can be used, whether the element is to be used at 10 MHZ or 10 GHz. Only the physical size and implementation i.e., element windings, will change.

There are numerous parametric combinations of $\beta$, a1, and N possible for specific design requirements. The effects of these combinations will be understood through numeric-theoretic studies (using NEC, for example, the Numerical Electromagnetic Code) and appropriate measurements of feed-point impedance, pattern, polarization purity (i.e., degree of circularity), and efficiency as a function of frequency. Other equations could be used to describe the sinuous component. For example, instead of using a sine wave, it might be easier for either computational or physical construction reasons to use a triangular wave. The object is to superimpose a deviation in the spiral winding to decrease the phase velocity around the circumference and thereby correspondingly decrease the diameter required to radiate efficiently at a specified minimum frequency. The following is a list of references cited herein:

Reference (1) "A New Wideband, Fully Steerable, Decametric Array at Clark Lake," W. C. Erickson and J. R. Fisher, Radio Science, vol. 9, no. 3, pp 387–401, March 1974;

Reference (2) "Broad-Band Antenna Array with Application to Radio Astronomy," IEEE Trans. Antennas Propagat., C. L. Rufenach, W. M. Cronyn and K. L. Neal, vol. AP-21, no. 5, pp 697–700, September 1973;

Reference (3) "Design of Multioctave Spiral-Mode Microstrip Antennas," J. J. H. Wang and V. K. Tripp, IEEE Trans. Antennas Propagat., vol. 39, pp 332–335, March 1991;

Reference (4) "Spiral Microstrip Antenna Suits EW/ECM Systems," J. J. H. Wang and V. K. Tripp, Microwaves and RF, vol. 32, no. 12;

References (5) U.S. Pat. No. 5,313,216 issued to Johnson J. H. Wang and Victor K. Tripp titled "Multioctave Microstrip Antenna" developed at the Georgia Institute of Technology by research funded through Wright-Patterson Air Force Base; and Reference (6) *DESIGN TESTS OF THE FULLY STEERABLE, WIDEBAND, DECAMETRIC ARRAY AT THE CLARK LAKE RATIO OBSERVATORY*, J. R. Fisher, Ph.D. Dissertation (University of Maryland, Astronomy Program, Department of Physics and Astronomy), 1972.

Obviously, many modifications and variations of the invention are possible in light of the above teachings. It is therefore to be understood that within the scope of the appended claims the invention may be practiced otherwise than as has been specifically described.

What is claimed is:

1. An antenna comprising:

a plurality of spiral shape antenna arms in which each of said arms has a radially inner and radially outer end and in which said radially inner ends are spaced rotationally about a common axis, and in which said arms are separated circumferentially from each other in proportion to their distance from said common axis, each of said spiral antenna arms including an antenna element having a generally sinusoidal shaped sinuous portion that has amplitude and period characteristics that increase with increasing distance from said common axis; and an antenna feed selectively coupled to said antenna elements.

2. The antenna of claim 1 in which said radially inner ends are equally spaced rotationally about said common axis.

3. The antenna of claim 1 in which at least one of said antenna elements is left uncoupled from said antenna feed.

4. The antenna of claim 1 in which said spiral shape is an exponential spiral.

5. The antenna of claim 1 in which said antenna is one of an array of antennas, and in which each of said antennas are selectively fed so that said array provides directional antenna beam control.

6. An antenna comprising:

a plurality of exponential-spiral shaped antenna arms in which each of said arms has a radially inner and radially outer end and in which said radially inner ends are spaced rotationally about a common axis by a predetermined angle relative to each other, and in which said arms are separated circumferentially from each other by a distance that increases with increasing distance from said common axis, each of said spiral antenna arms including a generally sinusoidal shaped sinuous antenna element having amplitude and period characteristics that increase with increasing distance from said common axis; and an antenna feed selectively coupled to said antenna elements.

7. The antenna of claim 6 in which said radially inner ends are equally spaced rotationally about said common axis.

8. The antenna of claim 6 in which at least one of said antenna elements is left uncoupled from said antenna feed.

9. The antenna of claim 6 in which said antenna is one of an array of antennas, and in which each of said antennas are selectively fed so that said array provides directional antenna beam control.

10. An antenna comprising:

eight exponential-spiral shaped antenna arms in which each of said arms has a radially inner and radially outer end and in which said radially inner ends are equally spaced rotationally about a common axis, and in which said arms are separated circumferentially from each other by a distance that increases with increasing distance from said common axis, each of said spiral antenna arms including a generally sinusoidal shaped sinuous antenna element having amplitude and period characteristics that increase with increasing distance from said common axis; and a balanced antenna feed having one side thereof operably coupled to a first set of three of said radially inner ends that are rotationally consecutive and having a second side thereof operably coupled to a second set of three of said radially inner ends that are rotationally consecutive, in which one of said antenna elements between each of said sets of antenna elements is left uncoupled from said antenna feed.

11. The antenna of claim 10, in which said antenna is one of an array of antennas, and in which each of said antennas are selectively fed so that said array provides directional antenna beam control.

* * * * *